United States Patent [19]

Dean

[11] 4,090,454

[45] May 23, 1978

[54] WEAVABLE RAILWAY TRUCK

[75] Inventor: Albert G. Dean, Narberth, Pa.

[73] Assignee: The Budd Company, Troy, Mich.

[21] Appl. No.: 754,872

[22] Filed: Dec. 27, 1976

[51] Int. Cl.[2] ..... B61D 3/08; B61D 5/18; B61D 5/20; B61D 5/52

[52] U.S. Cl. ..... 105/182 R; 105/199 R; 105/200

[58] Field of Search ..... 105/182 R, 182 E, 199 C, 105/199 R, 200; 308/137

[56] References Cited

U.S. PATENT DOCUMENTS

| | | | |
|---|---|---|---|
| 2,056,221 | 10/1936 | Wright et al. | 308/137 |
| 2,354,016 | 7/1944 | Haynes | 105/182 R |
| 2,408,230 | 9/1946 | Shoupp | 313/54 X |
| 2,796,841 | 6/1957 | Fahlbusch et al. | 105/199 C |
| 2,908,230 | 10/1959 | Dean | 105/182 R |
| 3,516,365 | 6/1970 | Lich | 105/182 R |
| 3,835,788 | 9/1974 | Paul et al. | 105/182 E |
| 3,974,780 | 8/1976 | Estrada | 105/182 R X |

*Primary Examiner*—Frank E. Werner
*Assistant Examiner*—Howard Beltran

[57] ABSTRACT

Railway truck construction in which truck side frames have considerable free weaving movement relative to each other about a center post of a truck bolster and in which the side frames have inner transom structure with center post bearing portions completely encircling the center post and fitting together in complementary arrangement in assembly.

5 Claims, 4 Drawing Figures

WEAVABLE RAILWAY TRUCK

BACKGROUND

Railway trucks, of the type represented by the construction disclosed in U.S. Pat. No. 2,908,230, issued to W. B. Dean on Oct. 13, 1959, have side frames with transom portions which weave about a center post carried by a truck bolster which rides on the sills of the side frames. Each side frame in the patent construction has a semi-cylindrical journal bearing structure with wear pads which engages the center post. In that construction the side frames are held together against side separation only be resilient axle bearing assemblies. In some later proposals transverse tie bars have been added to assist in avoiding side separation but the arrangement at the center post has remained the same. These prior arrangements do not provide a positive cross tie at the center post for holding the two side frames together in case of accident, such as a broken axle, or and after wear considerable looseness in tram develops.

SYNOPSIS OF DISCLOSURE

The present invention provides protection against side separation or mal-adjustment about the center post by providing each side frame with a center bearing collar or ring which completely encircles the center post, the rings being diposed one above the other on the center post and having complementary anchor elements to provide relatively equalized action.

DRAWINGS

The objects of the invention, as well as various features of novelty and advantages, will be apparent from the following description of an exemplary embodiment illustrated in the accompanying drawings, in which.

SPECIFIC EMBODIMENT

Figure 1:
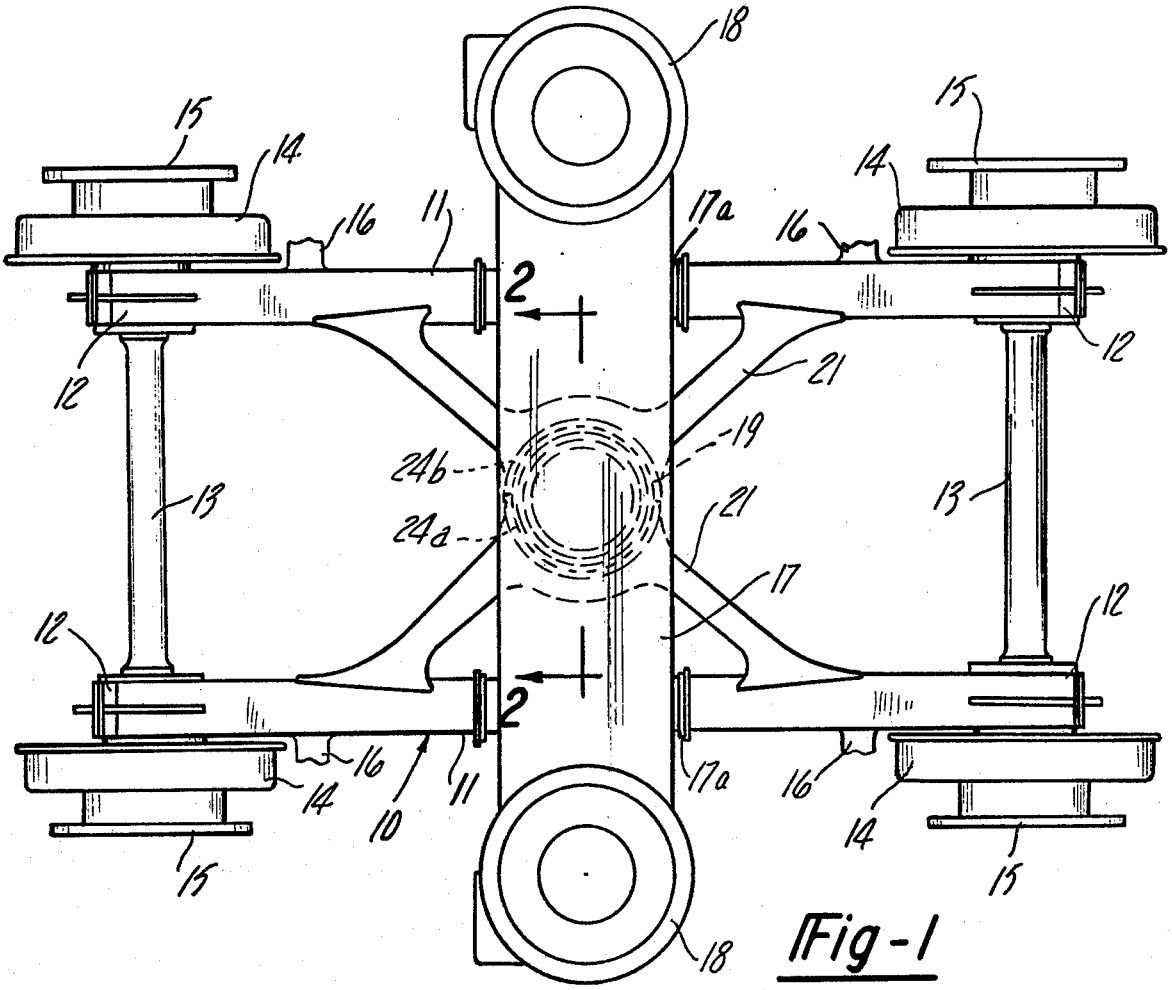
FIG. 1 is a plan view of a railway truck embodying the invention.

Referring to the drawings, a railway truck frame 10 include side beams or sills 11 of side frames which ride on bearings 12 on axles 13 having wheels 14. The bearings resiliently retain the side frames on the axles for relative side weave and maintain the side frames in parallelism as in the patent to W. B. Dean to which reference has been made.

The wheels 14 carry brake disks 15 which cooperate with brake mechanisms (not illustrated) carried by stub supports 16 rigid with the side sills of the truck frame.

A truck bolster 17 is supported for relative turning movements on pads 17*a* on the side sills, and the truck bolster 17 supports a body bolster by springs 18, (FIG. 1). The truck bolster 17 has a depending center post 19 about which turn and weave bearing portions or rings 20 secured on inwardly projecting transom portions 21 of the side frames.

Figure 4:
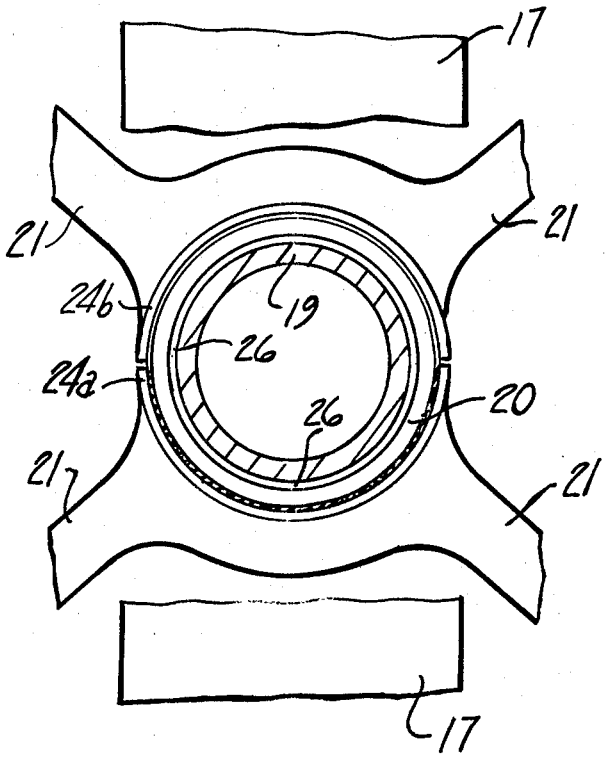
FIG. 4 is a portion of the plan view of FIG. 1 with portions broken away to better illustrate the center rings position about the center post.
Figure 2:
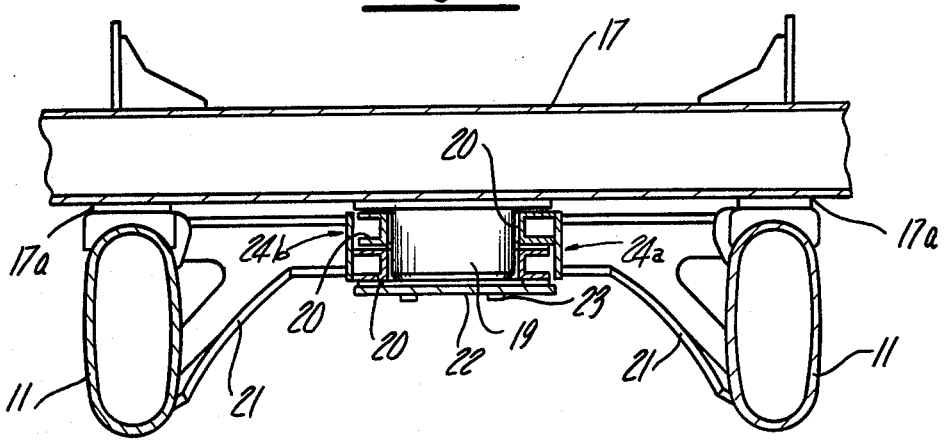
FIG. 2 is a partial enlarged transverse vertical section taken on the line 2—2 of FIG. 1.
Figure 3:
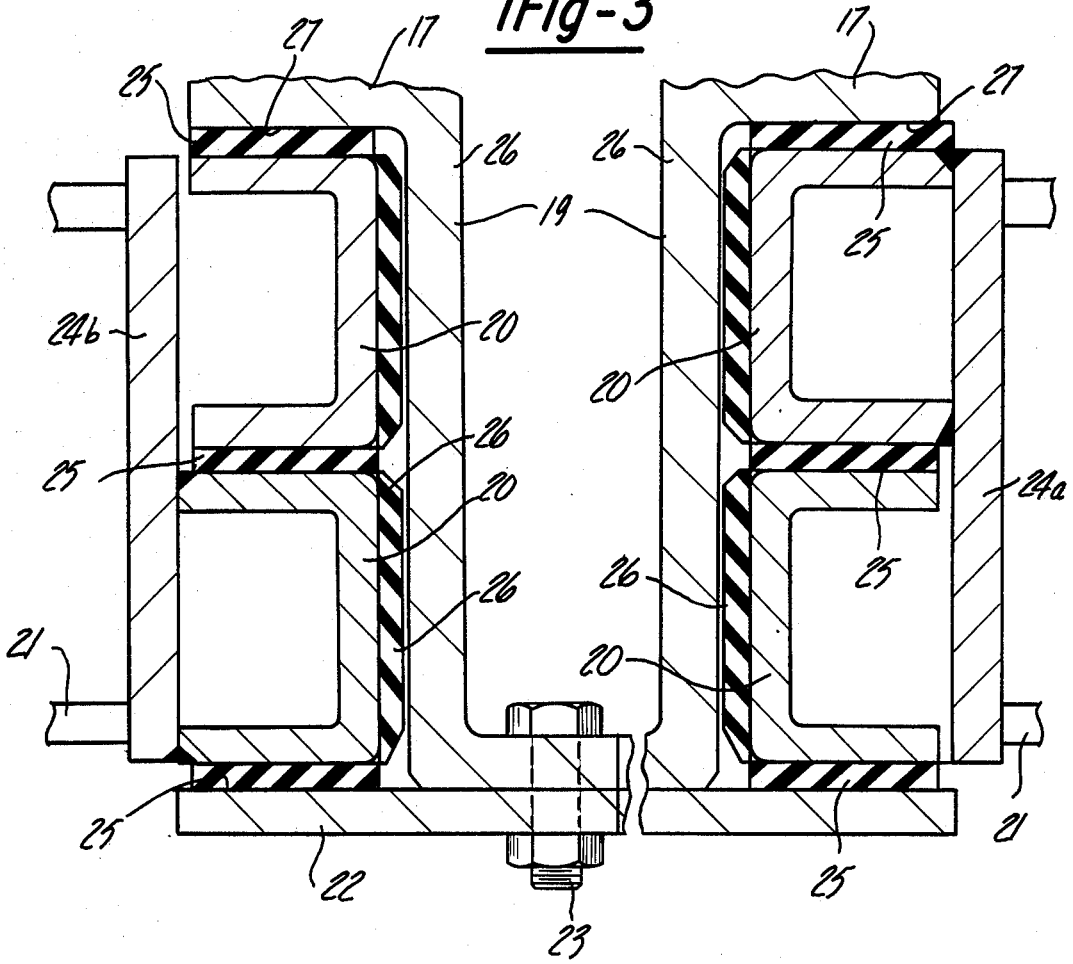
FIG. 3 is an enlarged view of parts shown at the center of FIG. 2.

It is the center post bearing portion 20 of the side frame transoms with which the present invention is particularly directed. As stated, the prior arrangements provided no means at the center post for positively holding the side frames together. The present invention provides for such positive retention. As illustrated, FIG. 1 and FIG. 4 each side frame transom projection 21 carries a complete bearing ring 20 which fully encircles the center post 19. The bearing rings are made unitary and are retained on the center post, as by a cap plate 22 retained by bolts 23. The rings 20 are disposed, one above the other, on the center post, each being secured to a semi-cylindrical anchor elements 24*a*, 24*b* of the respective transom members.

The anchor elements are not full half-cylinders but are somewhat shorter than half-circle so as to stand apart at the adjacent ends sufficiently, as shown in FIG. 1, to allow the required weaving movements between the side frames without interference.

The bearings 20 are held in position and allowed the necessary weaving movement about the center post by resilient yieldable elements, such as horizontal rings 25 and vertical rings 26. The top and bottom horizontal rings 25 are wear resistant pads, as of brake lining material, and the center horizontal ring is of an elastomeric material. The vertical rings 26 are resistant pads, as of brake lining material.

The retaining rings 20, thus formed and arranged, comprise complementary interfitting parts which are positively retained on the center post between a base surface 27 of the bolster 17 and the retaining plate 22.

It is thus seen that the present arrangement provides position retention of the side frame transom elements about the center post and allows all required weaving movements of the side frames about the center post. Separation of the bottoms of the frames is controlled by vertical reactions at the center pinot and side bearings, producing a movement at the connection of the transom to the frame. There is adequate retention of position after wear and no considerable looseness in tram after wear in service.

While one embodiment of the invention has been described for purposes of illustration, it is to be understood that there may be other embodiments and modifications within the general scope of the invention.

I claim:

1. A railway truck comprising in combination, side frame members having weaving movement on supporting axles, a center post about which the side frame members turn and weave, and a bearing ring means integral with and carried by internal extensions of said side frame members retainingly completely encircling said center post, and said center post having a removable end cap for retaining said bearing ring means about said center post.

2. A railway truck as set forth in claim 1, in which said bearing ring means are arranged one above the other about the center post.

3. A railway truck as set forth in claim 1, in which said bearing ring means are arranged one above the other and are integrally secured to semi-cylindrical anchorage means carried by said inwardly extending extensions.

4. A railway truck as set forth in claim 3, in which said anchorage means are foreshortened sufficiently to leave a small gap between them at the ends to permit rotating and weaving movement of said frames.

5. A railway truck as set forth in claim 4 wherein resilient wear pads are provided between said ring means and said center post.

* * * * *